US009259845B2

(12) United States Patent
Gringer et al.

(10) Patent No.: US 9,259,845 B2
(45) Date of Patent: Feb. 16, 2016

(54) CARPET CUTTER ASSEMBLY

(71) Applicant: ALLWAY TOOLS, INC., Bronx, NY (US)

(72) Inventors: Donald Gringer, New York, NY (US); Yuan Fang Cheng, Forrest Hills, NY (US)

(73) Assignee: ALLWAY TOOLS, INC., Bronx, NY (US)

( * ) Notice: Subject to any disclaimer, the term of this patent is extended or adjusted under 35 U.S.C. 154(b) by 0 days.

(21) Appl. No.: 14/306,613

(22) Filed: Jun. 17, 2014

(65) Prior Publication Data

US 2015/0360374 A1 Dec. 17, 2015

(51) Int. Cl.

| | |
|---|---|
| ***B26B 3/06*** | (2006.01) |
| ***B26B 5/00*** | (2006.01) |
| ***B26B 1/02*** | (2006.01) |
| ***B26B 29/02*** | (2006.01) |

(52) U.S. Cl.

CPC . *B26B 5/005* (2013.01); *B26B 1/02* (2013.01); *B26B 5/003* (2013.01); *B26B 29/02* (2013.01)

(58) Field of Classification Search

CPC ..... B26B 1/046; B26B 1/04; B26B 1/01; B26B 1/02

USPC ..... 30/155, 156, 334, 331, 157, 125, 329, 30/330

See application file for complete search history.

(56) References Cited

U.S. PATENT DOCUMENTS

| | | | | |
|---|---|---|---|---|
| 4,073,057 | A * | 2/1978 | Gilbert | 30/153 |
| 5,386,632 | A * | 2/1995 | Schmidt | 30/125 |
| 5,661,908 | A * | 9/1997 | Chen | 30/125 |
| 6,026,575 | A * | 2/2000 | Wonderley | 30/125 |
| 6,134,788 | A * | 10/2000 | Chen et al. | 30/125 |
| 6,675,485 | B1 * | 1/2004 | Shih et al. | 30/321 |
| 6,807,738 | B1 * | 10/2004 | Shih et al. | 30/321 |
| 6,845,561 | B2 * | 1/2005 | Timson | 30/125 |
| 6,971,178 | B2 * | 12/2005 | Rowlay | 30/162 |
| 7,181,849 | B2 * | 2/2007 | Menter | 30/159 |
| D624,386 | S * | 9/2010 | van Deursen | D8/99 |
| 8,006,389 | B2 * | 8/2011 | Jennings et al. | 30/162 |
| 8,572,850 | B2 | 11/2013 | Wu | |
| 8,806,760 | B2 * | 8/2014 | Moons | 30/155 |
| 2003/0037444 | A1 * | 2/2003 | Chunn | B26B 5/00 30/337 |

(Continued)

OTHER PUBLICATIONS

Allway Tools, Soft Grip Tools for Hard Hat Jobs, Product Catalog, 2008.

(Continued)

*Primary Examiner* — Omar Flores Sanchez

(74) *Attorney, Agent, or Firm* — Gottlieb, Rackman & Reisman, PC

(57) ABSTRACT

A carpet cutter assembly comprising a ribbed handle, an elongated internal channel opening along the lower surface, which houses the blade in a dosed position; an exposed blade storage mechanism on the handle for housing a plurality of replacement blades, the blade storage mechanism having a blade storage handle, which locks in a blade storage cavity to secure the blade in place; a locking wheel mechanism at the frontal end of the handle, which rotates the blade from an open, closed and loading position and secures the blade in these positions; a rotatable blade retainer located at the frontal end of the handle, wherein the blade is positioned for use; and a blade safety housing with a pivot opening through which the locking wheel shaft is inserted, wherein the housing engages with the retainer to secure the blade.

20 Claims, 8 Drawing Sheets

(56) References Cited

U.S. PATENT DOCUMENTS

| | | | | |
|---|---|---|---|---|
| 2006/0026844 | A1* | 2/2006 | Ping | 30/153 |
| 2008/0289190 | A1* | 11/2008 | Jennings et al. | 30/155 |
| 2009/0199409 | A1* | 8/2009 | Zeng | 30/154 |
| 2010/0180450 | A1* | 7/2010 | Van Deursen | 30/162 |
| 2012/0180325 | A1* | 7/2012 | Wu | B26B 5/00 33/330 |

OTHER PUBLICATIONS

"Folding carpet knife with 5 blades", Personna American Safety Razor Company, www.personnablades.com, Product Catalog, 2007-2014.

"Retractable carpet knife", Stanley Black & Decker, www.stanleytools.com, 2002-2013.

* cited by examiner

CARPET CUTTER ASSEMBLY

FIELD OF THE INVENTION

This invention relates to a carpet knife. More specifically the invention involves a carpet cutter assembly including a knife that can be stably fixed into multiple positions with the use of a locking wheel and a cutting blade that can be stored in the handle channel or easily exchanged with a blade in the storage cavity.

SUMMARY OF THE INVENTION

A carpet cutter is a type of utility knife, which is a commonly used hand tool specifically used for cutting carpet or a rug. A conventional carpet knife has a housing made up of a right cover and a left cover detachably coupled together by a screw or threaded wheel to form the housing, comprising a handle and a blade chamber. The blade chamber carries a cutting blade. The blade chamber has a slot that allows the blade to move into an active cutting position. The housing may hold spare blades, which are accessible upon detachment of the right and left covers.

In view of the deficiencies and drawbacks in the prior art, it is the primary object of the present invention to provide an improved carpet cutter assembly presented with superior efficiency for switching out a dull blade and placing a blade into a safe and closed position. The present invention allows carpenters to exchange a dull blade with a sharper blade without any additional tools or storage units.

Another object of the present invention is to provide a carpet knife that will minimize injuries to its users. The disclosed carpet knife accomplishes this objective by providing a user with two options to safely store the knife during non-use. The user may rotate the blade into the channel of the handle to be in the closed position or the user may remove the blade from the housing and place the blade in the storage compartment.

In summary, there is provided as a preferred embodiment of the present invention a carpet cutter assembly comprising a ribbed handle, an elongated internal channel opening along the lower surface, which houses the blade in a closed position; an exposed blade storage mechanism on the handle for housing a plurality of replacement blades, the blade storage mechanism having a blade storage handle, which locks in a blade storage cavity to secure the blade in place; a locking wheel mechanism at the frontal end of the handle, which enables rotation through open, closed and loading positions and secures the blade in these positions; a rotatable blade retainer located at the frontal end of the handle, wherein the blade is positioned for use; and a blade safety housing with a pivot opening through which the locking wheel shaft is inserted, wherein the housing engages with the retainer to secure the blade.

DESCRIPTION OF RELATED ART

The prior art includes carpet knives that have several drawbacks as compared to the present invention. U.S. Pat. No. 8,572,850 to Wu ("Wu") discloses a carpet knife that has a housing, a blade installed in the housing and a knife clamping means having a clamping cover and a thumb screw. The housing is comprised of several parts. Further, the thumb screw does not enable rotation between an open and closed position of the blade. Also, there is no blade storage unit in the housing that allows for easy replacement of a dull blade making it difficult for a carpenter to use.

Another carpet knife is the Kobalt "Folding Lock-Back Carpet Knife" made by Kobalt, which owned by Lowe's as their line of house brand tools. Lowe's corporate headquarters is located at 1000 Lowes Blvd., Mooresville, N.C., 28117. The Kobalt knife's handle is comprised of one unitary part with a channel that is used to house the blade when in a closed position. The Kobalt knife does not have a compartment to store extra blades when the active blade becomes dull.

Another carpet knife is the "Folding Carpet Knife with 5 Blades" made by Personna American Safety Razor Company ("Personna") located at 240 Cedar Knolls Road, Suite 401, Cedar Knolls, N.J. 07927. The Personna knife has a channel that houses the blade and blade holder in a closed position. However, this carpet knife does not have an additional storage compartment to hold extra blades. The Personna knife also does not have a locking wheel mechanism to allow the assembly to be in open, loading, or closed positions.

Another carpet knife is the "Retractable Carpet Knife" made by Stanley Black and Decker ("Stanley") located at 1000 Stanley Drive, New Britain, Conn. 06053. The Stanley knife is not unitary and does not have an exposed blade storage to allow for a simple exchange of blades. In order for a user to switch the blade for the Stanley knife, the user would have to take the whole knife apart.

DETAILED DESCRIPTION OF THE INVENTION

Figure 1:
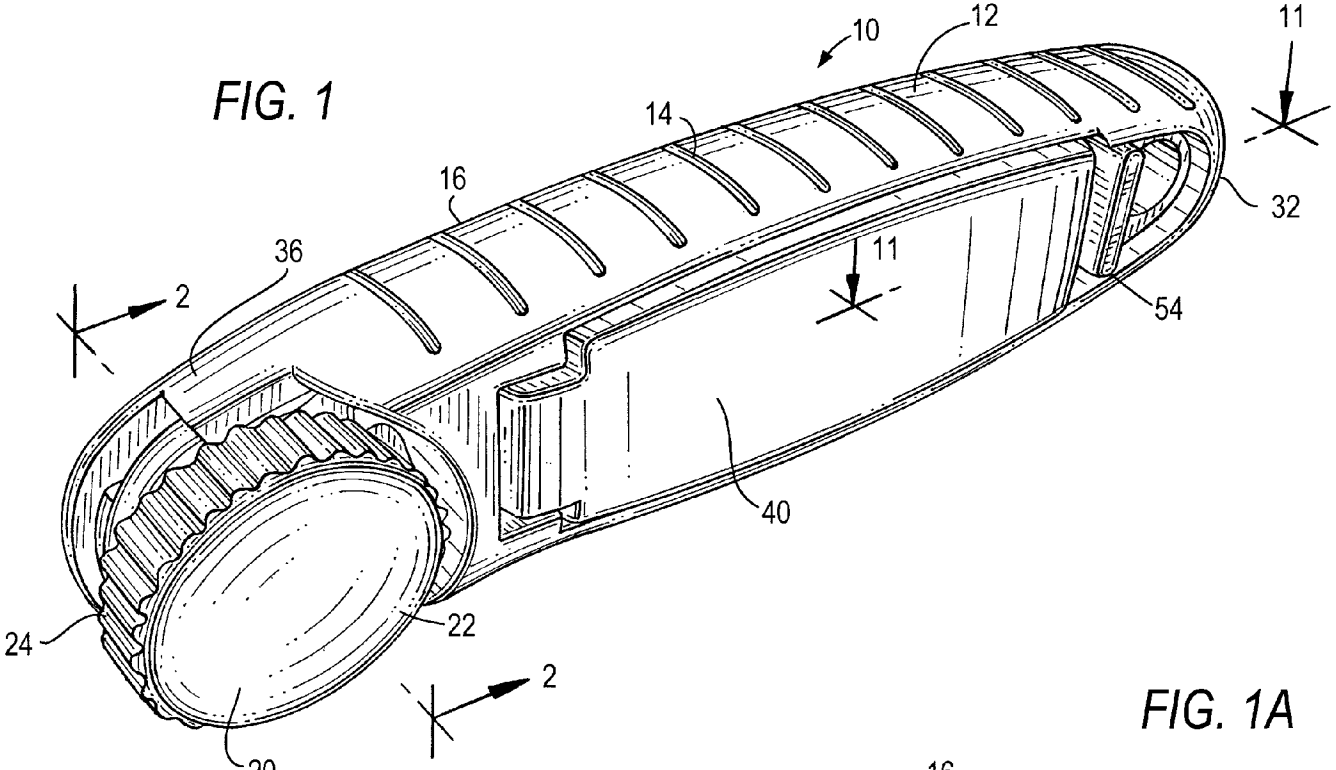
FIG. 1 is a perspective front view of the carpet cutter assembly shown in closed position.

With reference to FIGS. 1 through 12, there is shown a carpet cutter assembly 10 of the present invention. The assembly 10 has an elongated handle 12 with ribs 14 positioned on an upper surface 16 and a lower surface 17 of the handle 12. The ribs 14 are evenly spaced across and protrude from the upper surface 16 and lower surface 17 of the handle 12. The handle 12 tapers from its frontal end 34 to its rear end 32 and is generally rectangular in cross section. See FIG. 2.

The carpet cutter assembly 10 has a blade storage mechanism 40 on the handle 12 that houses one or more replacement blades B.

Figure 5:
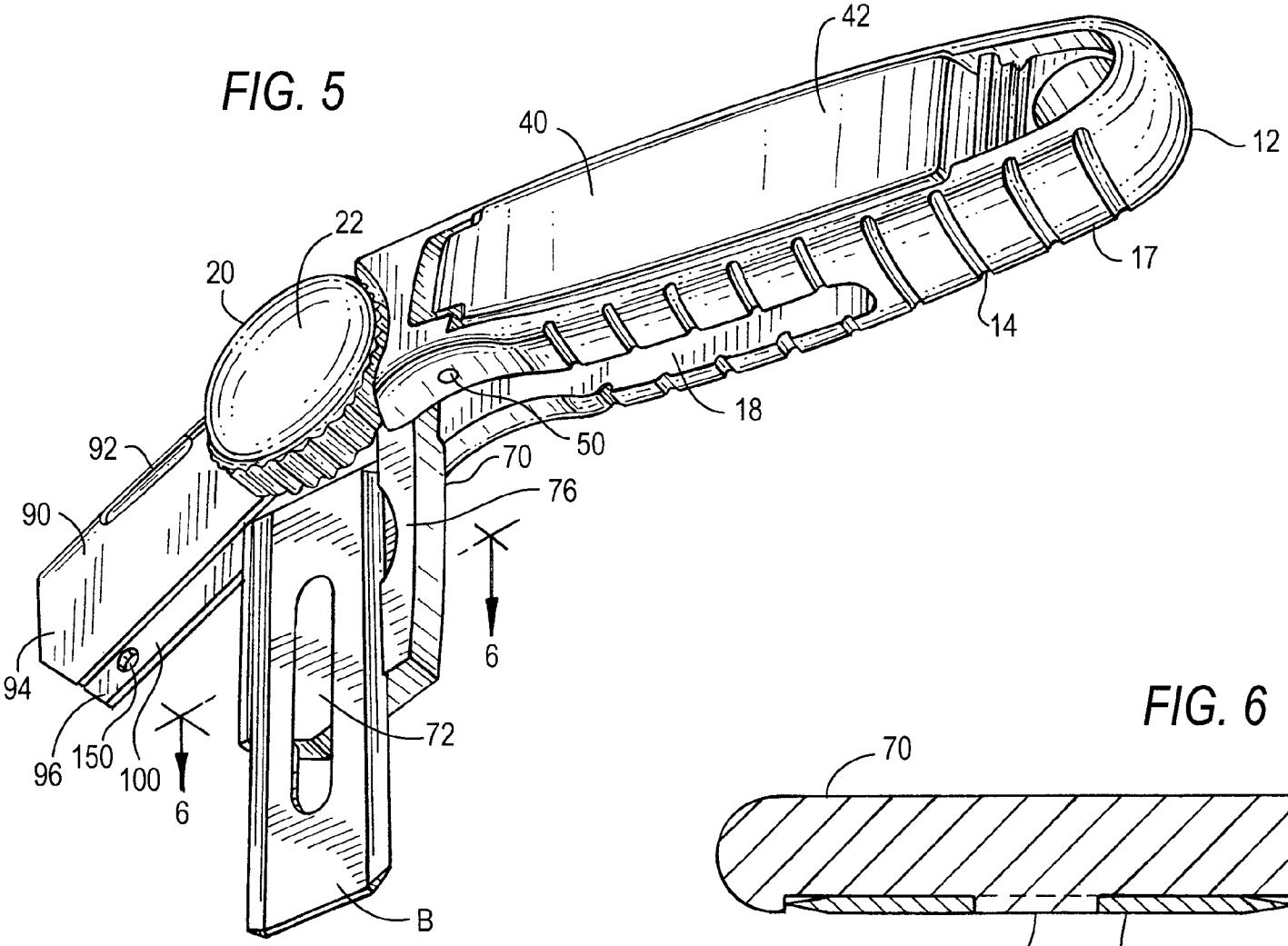
FIG. 5 is a bottom perspective view of the carpet cutter assembly being shown in a blade-loading position.
Figure 6:
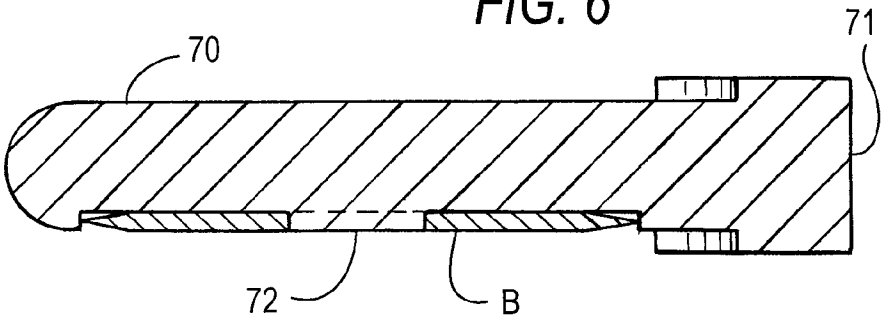
FIG. 6 is a cross-sectional view taken on a line 6-6 of FIG. 5.
Figure 7:
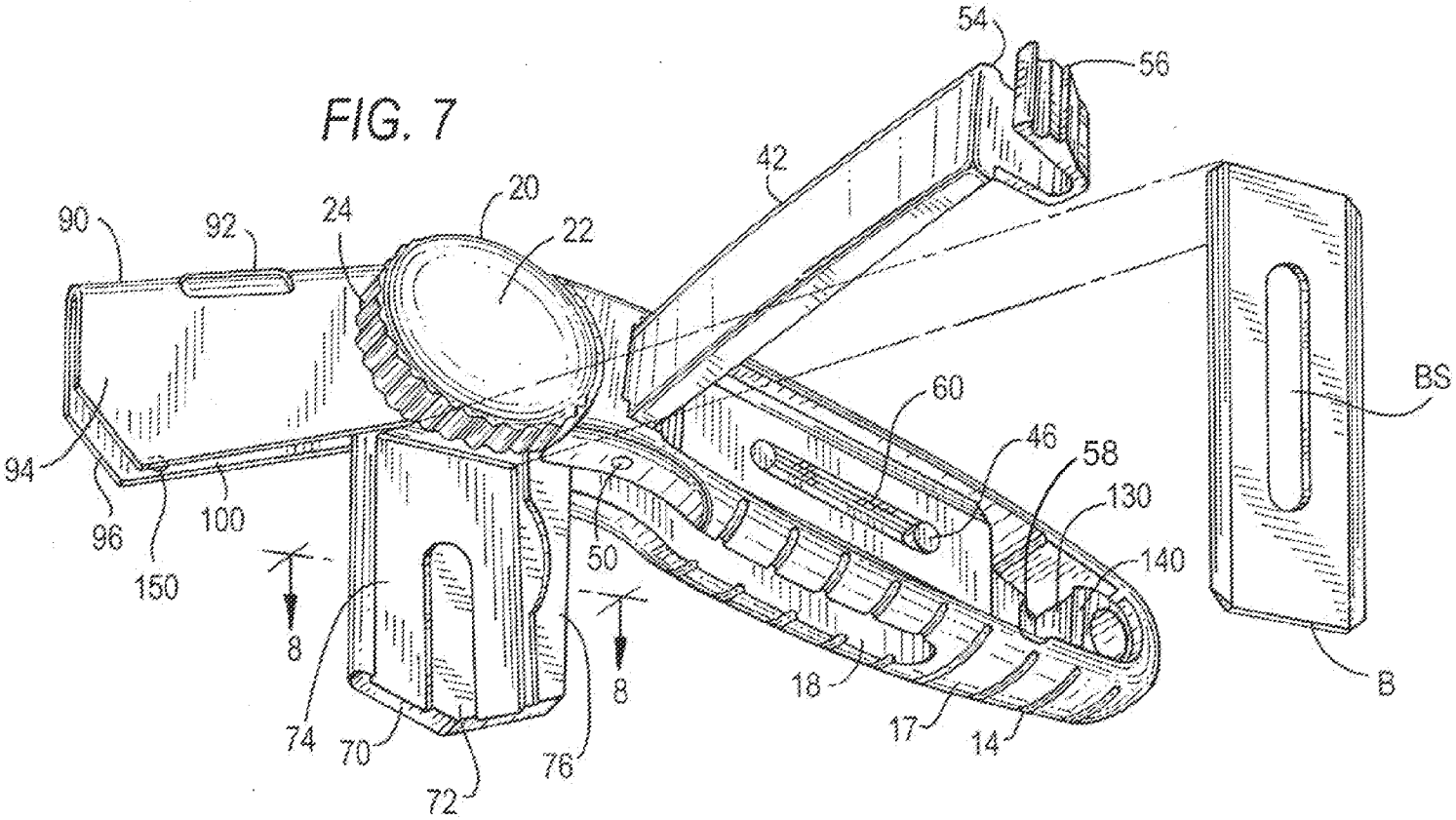
FIG. 7 is a bottom perspective view with carpet cutter assembly showing a placement of a blade while in a blade-loading position.
Figure 8:
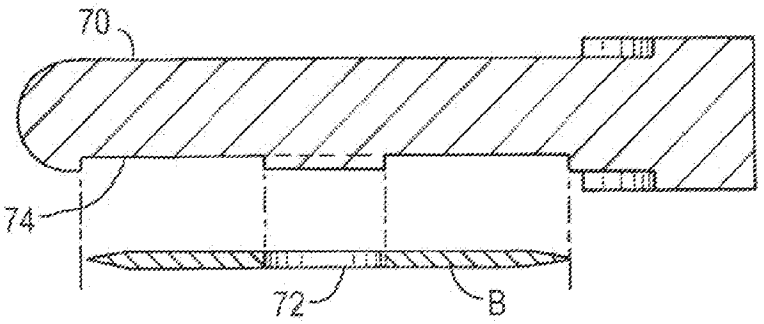
FIG. 8 is a cross-sectional view taken on a line 8-8 of FIG. 7.
Figures 9, 10:
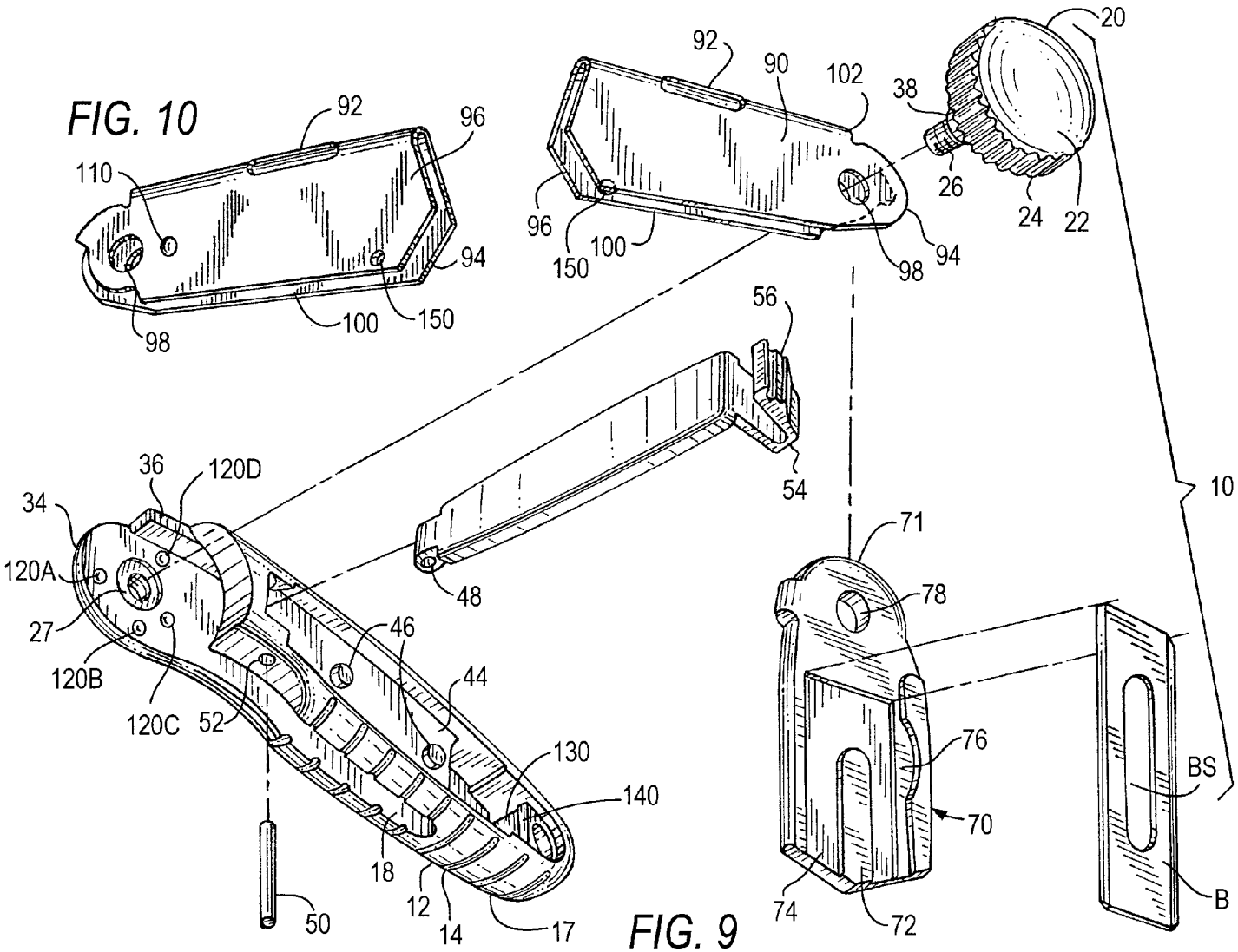
FIG. 9 is an exploded view of the carpet cutter assembly showing the components thereof.
FIG. 10 is a side and bottom perspective view of a blade safety housing, showing a side of said housing opposite of the side shown in FIG. 9.

As shown in detail in FIGS. 5, 7 and 9, the handle 12 is unitary with an interior elongated channel 18 that opens along the lower surface 17. The elongated channel 18 stores a blade safety housing 90 and a blade retainer 70 with an attached blade B in a closed position. The elongated channel 18 extends more than half way across the lower surface 17 and the width of said elongated channel 18 is slightly wider than the width of said blade safety housing 90.

As particularly shown in FIG. 7, the blade storage mechanism 40 is externally exposed, that is, can be opened by a user without taking apart another part of the assembly 10. It includes a blade storage handle 42 and a blade storage cavity 44. The handle 42 includes a grooved handle thumb contact 56 on the front end of a u-shaped handle retainer 54. The handle retainer 54 removeably latches onto the handle retainer receiver 58, which is located at the rearward end of the blade storage cavity 44. The blade storage cavity 44 has an elevated portion 60, which includes two blade retaining pins 46 that have a diameter equivalent to the width of the blade slot BS in the blade B. The blade storage handle 42 further has a pair of pivot openings 48. The handle 12 has a pair of pivot pin openings 52 in order to rotatably secure the blade storage handle 42 to the handle 12 upon insertion of a pin 50 into the pivot pin opening 52, which permits rotation of the handle 42 between open and closed positions. The storage mechanism 40 is located flat against handle 12, see FIG. 1, whereby a user may use the assembly for cutting carpet, without interference by the mechanism 40.

Figure 11:
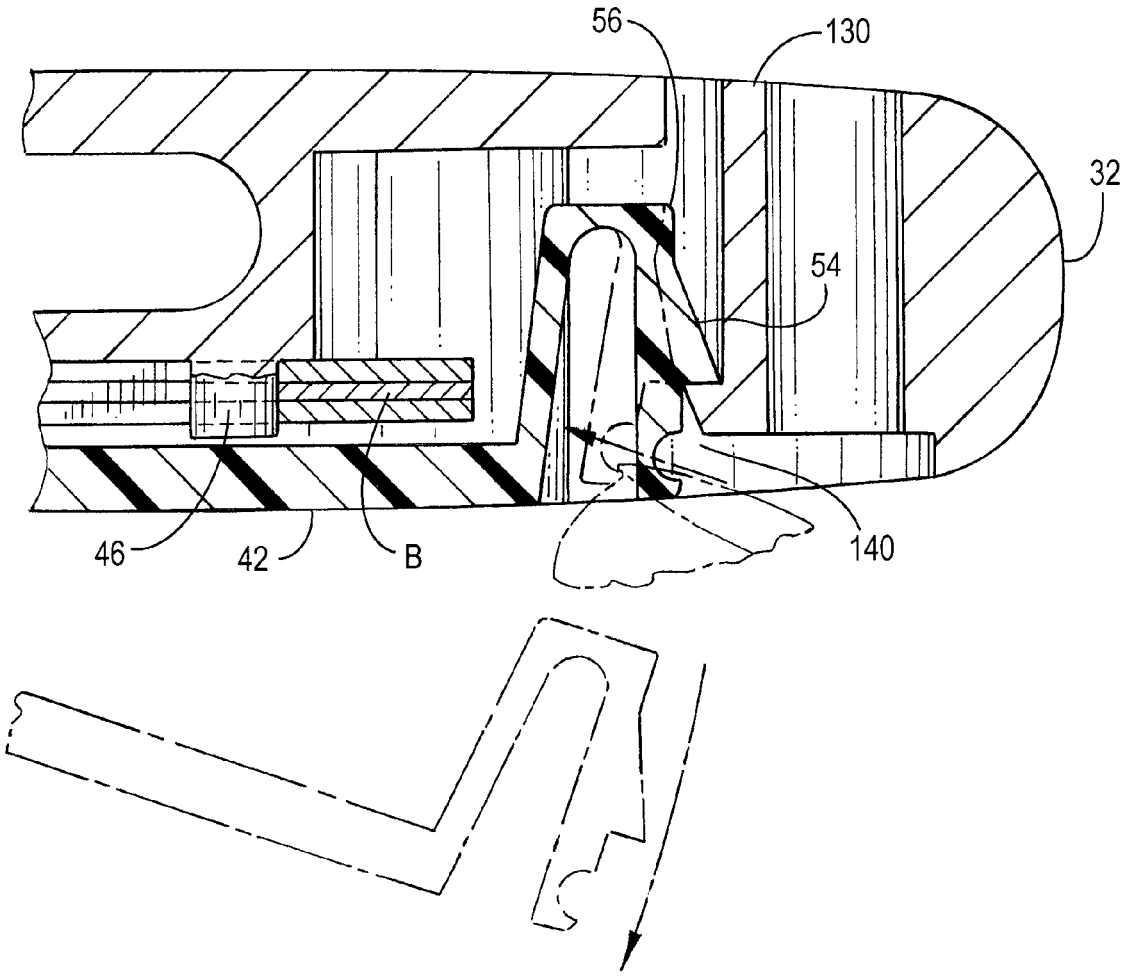
FIG. 11 is a cross-sectional view of a blade storage mechanism showing a blade storage handle in a closed position taken on a line 11-11 of FIG. 1.
Figure 12:
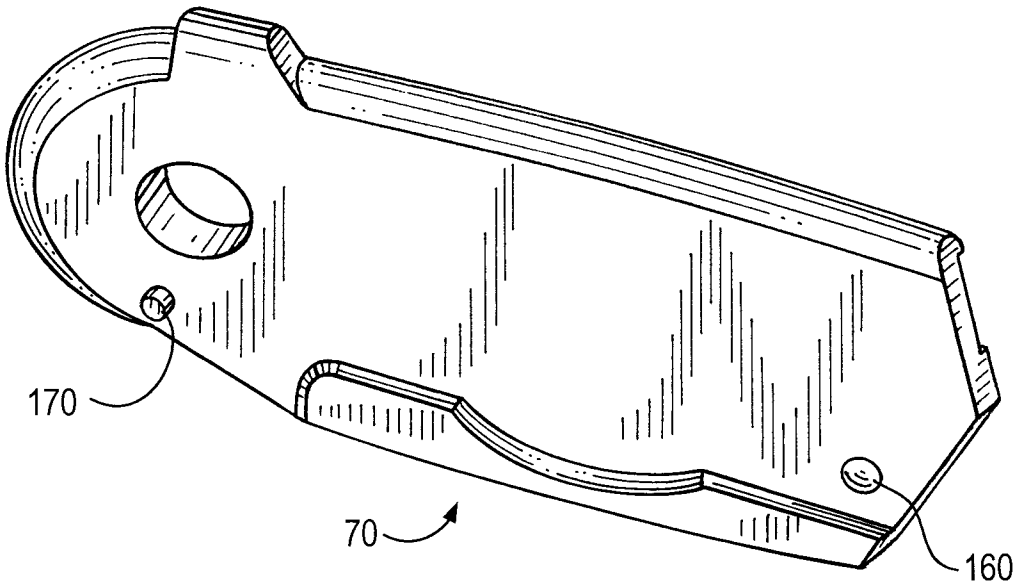
FIG. 12 is a side view of the blade retainer.

Further, as shown in FIG. 11, on the inside of the blade storage mechanism 40 there is an end wail 130 with a roof 140 extending outward towards the frontal end 34 of the handle 12. To close the blade storage mechanism 40, a user moves the blade storage handle 42 downward towards the end wall 130 and places pressure onto the blade storage handle 42 until the grooved handle thumb contact 56 becomes fully engaged with the roof 140 of the end wall 130. To open the blade storage mechanism 40 a user applies pressure and pushes the thumb contact 56 in and then upwards.

The carpet cutter assembly 10 further has a rotatable locking wheel mechanism 20 stationed at the frontal end 34 of the handle 12. The wheel 20 has a flat external surface 22 and ribs 24 on its circumference. The wheel 20 has a threaded shaft 26 which protrudes from a cylindrical stud 38 on its interior. The carpet cutter assembly 10 has a threaded shaft receiver 27 on the interior of the frontal end 34 of the handle 12 to receive the threaded shaft 26. See FIGS. 2 and 9.

As particularly shown in FIG. 9, the carpet cutter assembly 10 is assembled with a rotatable blade retainer 70, which is located at the frontal end of the handle 12. The blade retainer 70 has a stud 72 which is located within a cavity 74. The stud 72 and cavity 74 are sized to secure the blade B and to hold the blade B so that one end is exposed for cutting. The blade retainer 70 further has a thumb slot 76 and a retainer pivot opening 78 located at the retainer head 71. The retainer pivot opening 78 is circular to allow the locking wheel shaft 26 to pass through it in order for the blade retainer 70 to be rotatably secured to the handle 12.

As further shown in FIGS. 9 and 10, there are a pair of indents 120A and 120C on the frontal end 34 of the handle 12 that interlock with a detent 110 on a side wall 96 of a blade safety housing 90 when rotated between a dosed or opened position. The interlocking of the indent 120A and the detent 110 in an open position provides a safety feature for the user when the blade is in its open position. There is an additional indent 120C that interlocks with the detent 110 when the blade B is rotated in a closed position. The indents 120A and 120C further prevent the blade B from falling out of the blade storage mechanism 40 unexpectedly. Also, at the frontal end 34 of the handle 12 there is an anvil 36 that limits the rotation of the knife assembly 30.

The blade retainer 70 is rotatably stored in the blade safety housing 90, see FIGS. 9 and 10, which include a slot opening 100 formed by two parallel side walls 94, 96. The slot opening 100 has a width marginally larger than the width of the blade retainer 70, in order to removeably or securely hold the blade retainer 70. There is an additional half ball 160 on the exterior of the blade retainer 70, which engages with a hole 150 on the interior wall 96 of the blade safety housing 90, see FIGS. 9, 10 and 12. The half ball 160 further prevents the blade B from disengaging out of the blade retainer 70 upon the application of excessive force by a user. The housing 90 further includes a housing grip 92 to allow the user to maneuver the blade safety housing 90 to different positions relative to the blade retainer 70. The blade safety housing has a pivot opening 98 through which the locking wheel shaft 26 is inserted. Additionally, the blade retainer 70 has a raised pin 170 near the retainer head 71, which interlocks with indents 120B and 120D on the frontal end 34 of the handle 12, see FIGS. 9 and 12. The raised pin 170 engages with indent 1208 upon rotation of the retainer 70 into an open position. On the other hand, the raised pin 170 engages with indent 120D upon rotation of the retainer into a closed position.

As shown in further detail in FIG. 7, the assembly 10 includes the handle 12, the blade retainer 70, the blade safety housing 90, and the locking wheel 20. In the assembly 10, the locking wheel shaft 26 passes through the pivot opening 98 of the housing 90 and the pivot opening 78 of the retainer 70 upon being inserted into the shaft receiver 27 of the handle 12. The locking wheel shaft 26 is rotated or screwed into the shaft receiver 27 to secure the retainer 70 and the housing 90. The retainer 70 is then fitted into the housing 90 to form the knife assembly 30. Upon rotation between the open and closed position, a detent 110 on the blade safety housing 90 locks into an indent 120 on the handle 12 to further secure the knife assembly 30.

Figure 3:
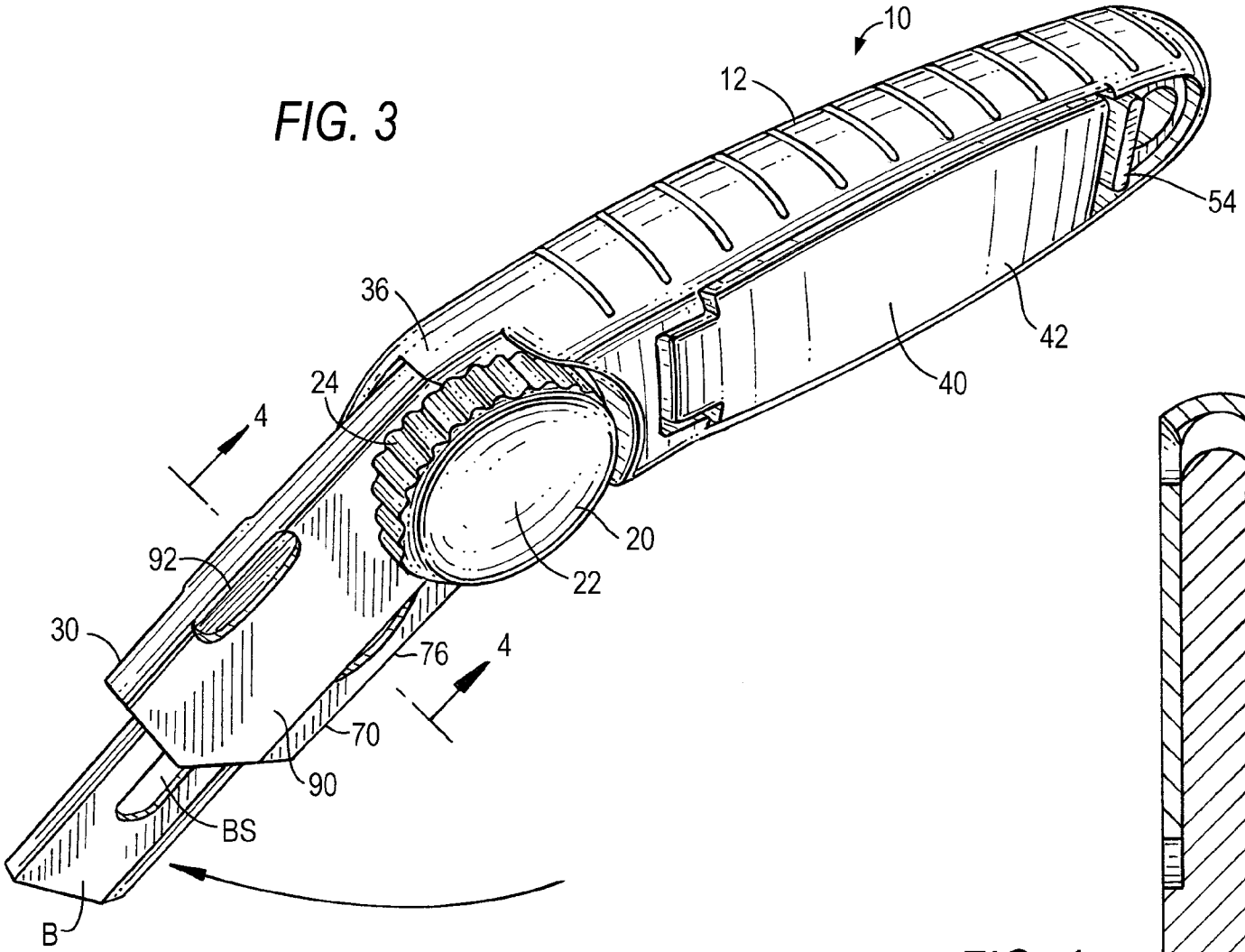
FIG. 3 is a perspective front view of the carpet cutter assembly shown in an opened or cutting position.
Figure 4:
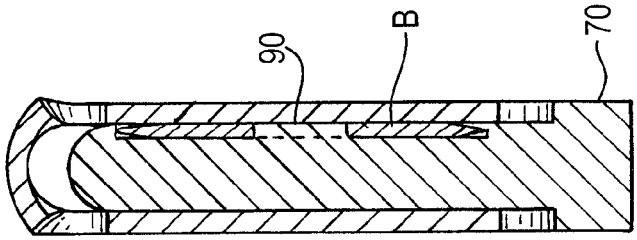
FIG. 4 is a cross-sectional view taken on a line 4-4 of FIG. 3.

For use of the carpet cutter assembly 10, the blade retainer 70 and blade safety housing 90 may initially be placed in a closed position in the elongated channel 18 of the handle 12. See FIGS. 1 and 1A. At this point, the locking wheel mechanism 20 may be tightened. A user then rotates the locking wheel mechanism 20 counterclockwise until the clamping force has lessened to enable rotatable movement of the blade retainer 70 and the blade safety housing 90 to the cutting position as shown in FIG. 3. The user removes the retainer 70 and the housing 90 from the channel 18 by grasping the housing grip 92. The retainer 70 and the housing 90 are rotated upward or clockwise as seen in the various figures, until the housing 90 at the bottom end 102 impacts the anvil 36 on the frontal end 34 of the handle 12. The anvil 36 performs as a stopper to prevent further rotation of the retainer 70 and housing 90 and greater security when applying force downward when cutting carpet. Upon reaching the retainer 70 and housing's 90 upward most position, a detent 110 on the side wall of the housing 90 and the raised pin 170 of the retainer 70 engage with the indents 120A and 120B on the handle 12, respectively.

To replace a blade, the user grasps the housing grip 92 with one hand and the thumb slot 76 on the retainer 70 with the other hand in order to release the retainer 70 from the housing 90. Additional pull may be needed in order to disengage the half ball 160 on the retainer 70 from the hole 150 on the interior of the blade safety housing 90. At this point, the retainer 70 is generally perpendicular to the handle 12 and in position to receive a blade B. See FIGS. 5 and 7. To remove a blade B from the blade storage mechanism 40 a user presses his or her thumb against the grooved handle thumb contact 56 and pushes the u-shaped handle retainer 54 inward then upward revealing the blade storage cavity 44. A blade B from the cavity 44 is next positioned and secured onto the cavity 74 of the blade retainer 70. Further, the retainer 70 is next rotated upward and locks into the blade safety housing 90 through the slot opening 100. Complete rotation occurs when the half ball 160 of the retainer 70 locks into the hole 150 of the housing. The user then rotates the locking wheel 20 clockwise until closing pressure is applied, and rotation of the wheel can no longer continue. At this moment, the blade B is tightly clamped and ready for use.

Figure 1A:
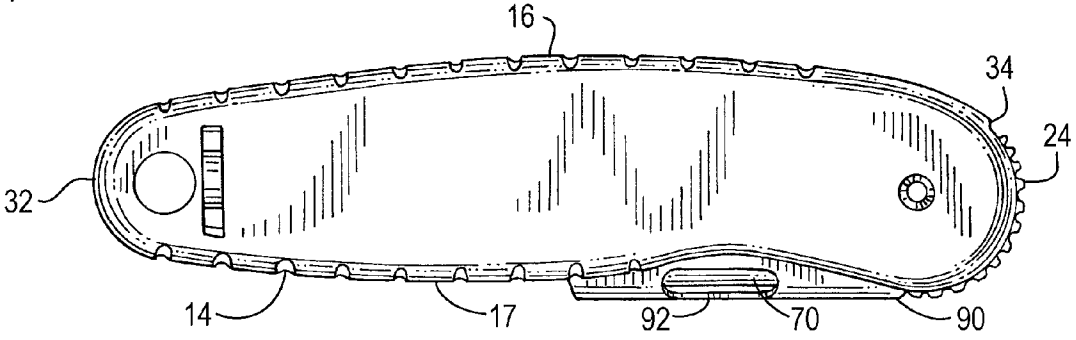
FIG. 1A is a right side view of the carpet cutter assembly in a dosed position.
Figure 2:
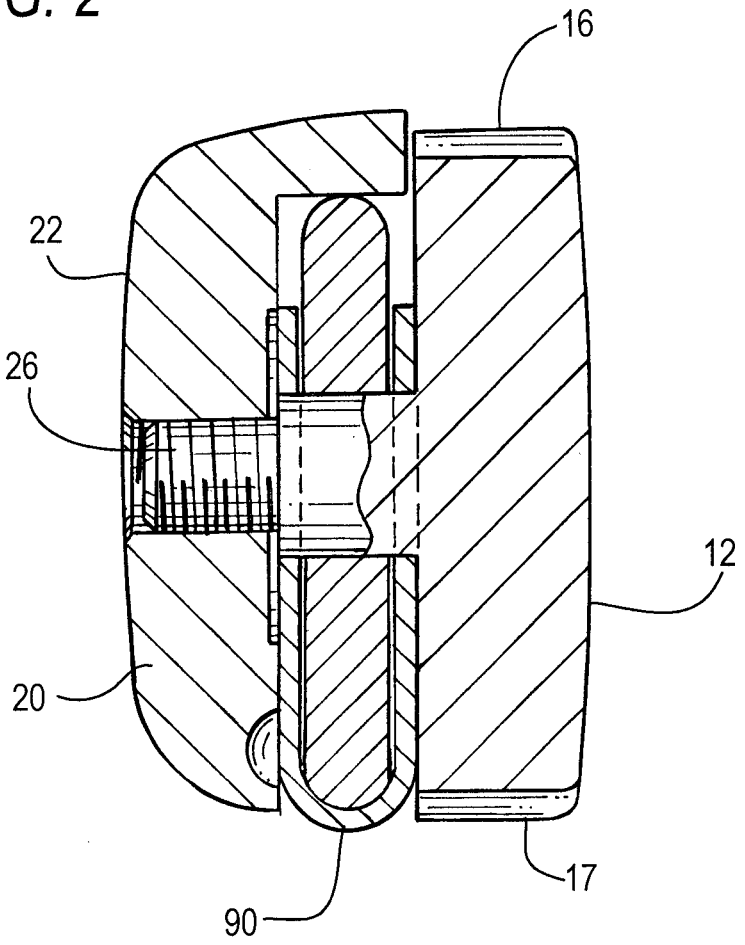
FIG. 2 is a side sectional view taken on a line 2-2 of FIG. 1.

To place the blade B in a closed position as shown in FIG. 1 and FIG. 1A, the user rotates the locking wheel mechanism 20 loosening the clamping force on the blade safety housing 90 and the blade retainer 70. At this time, the user is able to rotate the blade safety housing 90 and the blade retainer 70 with the attached blade B into the elongated channel 18 of the handle 12. To firmly secure the housing 90 and the retainer 70, the user rotates the locking wheel 20 clockwise until tightly fastened. Upon the blade B being placed in a closed position, a detent 110 on the side wall of the housing 90 and the raised pin 170 of the retainer 70 engage with the indents 120C and 120D on the handle 12, respectively.

It will be seen from the above description, that with the blade housing mechanism 90, which is firmly pressed to the blade retainer 70 by the locking wheel mechanism 20, the blade B is very stably clamped and will not move cross-sectionally in use. Furthermore, a rotation of the locking wheel mechanism 20 and movement of the blade retainer 70 and blade safety housing 90 into the elongated channel 18 will allow the blade B to be placed in a safe position.

The accompanying drawings illustrate a single embodiment of a carpet cutter assembly and its respective constituent parts, however, other types and styles are possible, and the drawings are not intended to be limiting in that regard. Thus, although the description above and accompanying drawings contains much specificity, the details provided should not be construed as limiting the scope of the embodiment but merely as providing illustrations of some of the presently preferred embodiment. The drawings and the description are not to be taken as restrictive on the scope of the embodiment and are understood as broad and general teachings in accordance with the present invention. While the present embodiment of the invention has been described using specific terms, such description is for present illustrative purposes only, and it is to be understood that modifications and variations to such embodiment, including but not limited to the substitutions of equivalent features, materials, or parts, and the reversal of various features thereof, may be practiced by those of ordinary skill in the art without departing from the spirit and scope of the invention.

The invention claimed is:

1. A carpet cutter assembly enabling cutting with a blade, the assembly comprising:

a unitary handle having an elongated channel extending inwardly from a surface of the handle;

an externally exposed blade storage mechanism on said handle;

a blade retainer rotatably mounted on said handle and sized to hold a blade;

a blade safety housing rotatably mounted directly on said handle having a slot opening sized to receive the blade retainer; and a locking wheel mechanism having a shaft extending from one side that is rotatably mounted to said handle with said shaft directly fixing said blade retainer and said blade safety housing to said handle, wherein said locking wheel mechanism is adjustable to permit the blade retainer and the blade safety housing to be directly pivotable about said shaft of said locking wheel mechanism between a closed position in the elongated channel, an intermediate blade loading position, and a blade cutting position.

2. A carpet cutter assembly as set forth in claim 1, wherein said handle has a plurality of ribs extending along said lower surface and said upper surface, and said head further is tapered from said frontal end to said rear end.

3. A carpet cutter assembly as set forth in claim 1, wherein said elongated channel extends more than half way across the lower surface of said handle.

4. A carpet cutter assembly as set forth in claim 1, wherein said blade storage mechanism includes a rotatable blade storage handle and a blade storage cavity.

5. A carpet cutter assembly as set forth in claim 4, wherein said blade storage handle includes a grooved handle thumb contact on the front end of a u-shaped handle retainer.

6. A carpet cutter assembly as set forth in claim 5, wherein said blade storage mechanism has an end wall with a roof to provide for interlocking with said grooved handle thumb contact of said blade storage handle in a closed position.

7. A carpet cutter assembly as set forth in claim 6, wherein said handle retainer removeably latches onto the handle retainer receiver located at the end of the blade storage cavity.

8. A carpet cutter assembly as set forth in claim 7, wherein said blade storage cavity includes an elevated portion with two blade retaining pins having a diameter equivalent to a width of a blade slot of a blade.

9. A carpet cutter assembly as set forth in claim 8, wherein said blade retainer has a half ball that is engaged with a hole on said blade safety housing.

10. A carpet cutter assembly as set forth in claim 1, wherein said handle has a pair of pivot openings to rotatably secure said blade storage handle upon insertion of a pin through a pivot pin opening.

11. A carpet cutter assembly as set forth in claim 1, wherein said locking wheel mechanism is stationed at the frontal end of the handle.

12. A carpet cutter assembly as set forth in claim 1, wherein said locking wheel mechanism includes a flat external surface and ribs along its rim.

13. A carpet cutter assembly as set forth in claim 11, wherein said locking wheel mechanism has a threaded shaft protruding from a cylindrical stud on its interior and the threaded shaft engaging with a threaded shaft receiver on the interior of the frontal end of said handle.

14. A carpet cutter assembly as set forth in claim 1, wherein said blade retainer has a stud, a cavity sized to secure a blade in a blade cutting position, a thumb slot and a retainer pivot opening located at a retainer head.

15. A carpet cutter assembly as set forth in claim 1, wherein said handle includes a pair of indents interlocking with a detent on a side wall of said blade safety housing when in a closed position or a blade cutting position.

16. A carpet cutter assembly as set forth in claim 1, wherein said handle includes a pair of indents interlocking with a detent on a side wall of said blade safety housing and a raised pin on the blade retainer when in a closed position.

17. A carpet cutter assembly as set forth in claim 1, wherein said handle has an anvil limiting the rotation of the assembly upon impact with the bottom end of said blade safety housing.

18. A carpet cutter assembly as set forth in claim 1, wherein said slot opening of said blade safety housing is formed by two parallel sidewalls and includes a housing grip for maneuverability and a pivot opening for insertion of said locking wheel shaft.

19. A carpet cutter assembly, comprising:

a handle having an elongated channel extending therein;

an externally exposed blade storage mechanism at least partially formed in a longitudinally extending sidewall of said handle;

a blade retainer rotatably mounted to said handle;

a blade safety housing rotatably mounted directly to said handle having a slot opening sized to receive the blade retainer; and a locking wheel mechanism having a shaft that is rotatably mounted to said handle with said shaft directly fixing said blade retainer and said blade safety housing to said handle, wherein the blade retainer and the blade safety housing are directly pivotable about the shaft between a closed position in the elongated channel, an intermediate loading position and an open position.

20. A carpet cutter assembly as set forth in claim 1, wherein said externally exposed blade storage mechanism is arranged in a longitudinally extending sidewall of said handle.

* * * * *